United States Patent [19]

Funk

[11] 4,105,003

[45] Aug. 8, 1978

[54] FUEL DISTRIBUTION SYSTEM

[76] Inventor: Raymond E. Funk, 9 Chapman Dr., Lexington Park, Md. 20653

[21] Appl. No.: 603,187

[22] Filed: Aug. 8, 1975

[51] Int. Cl.[2] ..... F02M 29/00

[52] U.S. Cl. ..... 123/141; 261/78 R

[58] Field of Search ..... 123/141; 261/78 R; 48/180 R, 180 B

[56] References Cited

U.S. PATENT DOCUMENTS

| | | | |
|---|---|---|---|
| 1,106,452 | 8/1914 | Lttner | 123/141 |
| 1,873,082 | 8/1932 | Vostrey | 123/141 |
| 2,152,206 | 3/1939 | Neal | 123/141 |
| 2,701,557 | 2/1955 | Ramey | 123/141 |
| 3,467,072 | 9/1969 | Toesca | 123/141 |
| 3,530,844 | 9/1970 | Kawai | 123/141 |
| 3,583,377 | 6/1971 | Graziano | 123/141 |

*Primary Examiner*—Charles J. Myhre
*Assistant Examiner*—Ira S. Lazarus
*Attorney, Agent, or Firm*—Woodard, Weikart, Emhardt & Naughton

[57] ABSTRACT

An improved fuel distribution system is disclosed herein which includes a baffle mounted in a carburetor between the venturi and the butterfly valve to direct the flow of fuel particles leaving the carburetor venturi evenly to both sides of the carburetor throttle butterfly when set at any position. At partial throttle settings, the rich and lean fuel-air mixture of today's carburetors are minimized. A screen or second baffle is included to further enhance the effect of the system. The resulting fuel-air mixture entering the intake manifold is vaporized before entering the combustion chamber where it will be burned more completely and the exhaust will be relatively free of pollutants.

3 Claims, 6 Drawing Figures

FUEL DISTRIBUTION SYSTEM

BACKGROUND OF THE INVENTION

This invention relates to devices that guide the fuel particles as they leave the carburetor venturi and enter the airflow around the butterfly valve. This forced mixing of fuel particles and air, allows the mixture passing the throttle butterfly to remain at the proper fuel-air ratio on each side of the throttle butterfly at all throttle settings. Present day carburetors cause all of the fuel leaving the venturi to pass only on one side of the throttle butterfly at low power settings of the throttle. The only fuel entering the air passing the upper plate of the throttle butterfly is the idle mixture fuel which is insufficient in quantity and poorly mixed at low power settings of the throttle. Also if the presently used inefficient intake manifolds were upgraded, the carburetors now in use would still allow unbalanced fuel-air mixtures to enter the different cylinders of the engine. Predictably, the results would still be poor economy, poor performance, incomplete burning of the mixture in the combustion chamber, and some pollutants remaining in the exhaust.

SUMMARY OF THE INVENTION

In a fuel distribution system having a carburetor for combining a fuel spray with air passing therethrough, the carburetor including a venturi for introducing the fuel spray into the air, the carburetor further including a cylindrical wall portion defining a passageway, the combined fuel and air passing from the venturi through the passageway, a butterfly valve being located within the passageway and operable to vary the sizes of the two openings between opposed ends of the butterfly valve and the wall portion of the carburetor to regulate the flow of the combined fuel and air through the passageway, the improvement comprising baffle means for evenly distributing the combined fuel and air to the two openings defined by the opposed ends of the butterfly valve and the wall portion of the carburetor, said baffle means including a baffle positioned between the venturi and the butterfly valve.

The object of this invention is to evenly distribute the fuel particles in the airflow within the carburetor before entering the intake manifold where they will be heated and vaporized.

DESCRIPTION OF THE PREFERRED EMBODIMENT

Figure 1:
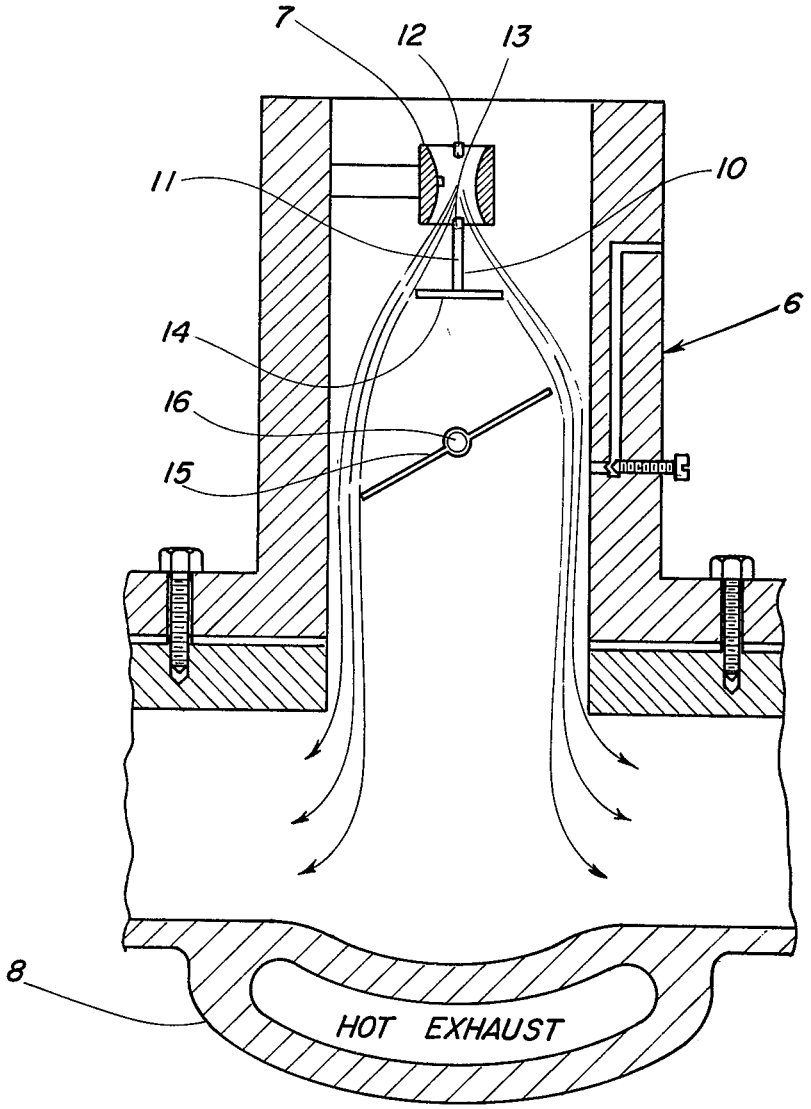
FIG. 1 is a plan view of the improved fuel distribution system according to the present invention.

FIG. 1 shows baffle 14 of baffle device 10 attached by arms 11 to the carburetor venturi 7 of carburetor 6. As can be seen by the arrows representing the paths of fuel particles, the fuel is forced outward into the airflow thus creating an equal fuel-air ration through the openings on each side of the throttle butterfly 15. Without baffle 14 installed in carburetor 6, the fuel particles would all pass on the left side of the throttle butterfly 15. Cylinders would receive a richer fuel-air mixture from the left passage of the intake manifold 8 than from the right passage.

Figure 2:
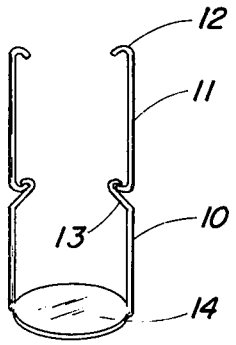
FIG. 2 is a perspective view of one embodiment of the baffle utilized in the improvement of the present invention.

FIG. 2 is a sectional view of the baffle device 10 in FIG. 1. The device is preferably made from approximately 1/32 inch thick sheet metal. Circular baffle 14 is approximately the diameter of the venturi 7 and is positioned below the venturi 7 the same distance as the diameter of baffle 14, but at full throttle, it must clear throttle butterfly 15. If there is insufficient clearance between venturi 7 and throttle butterfly 15, baffle 14 can be placed closer to venturi 7 as long as disruption of fuel flow is not experienced. Baffle 14 is attached to venturi 7 by one or two 3/32inch wide strips 11 of metal with bend 13 below the venturi and bend or hook 12 above. The metal strips are positioned parallel with the throttle butterfly pin 16 so that the fuel particles can be guided past the throttle butterfly with minimum contact with the butterfly and pin.

Figure 3:
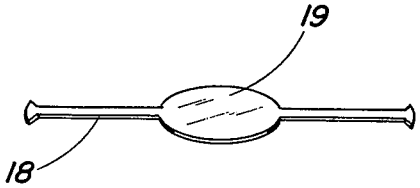
FIG. 3 is a perspective view of a second embodiment of a baffle utilized in the improvement of the present invention.
Figure 4:
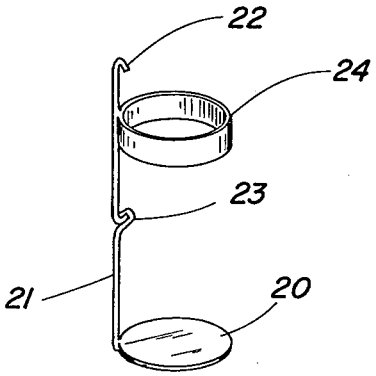
FIG. 4 is a perspective view of a third embodiment of a baffle utilized in the improvement of the present invention.

FIG. 3 shows a second embodiment of a baffle device utilized by the present invention with baffle 19 attached by 2 metal rods or strips 18 to the carburetor wall. The baffle device of FIG. 4 is similar to FIG. 2 with the addition of circular attachment or sleeve 24 which is required to attach the device to some two-barrel carburetors.

The baffle device further includes baffle 20, attaching arm 21, hook 22 and bend 23, which operate similar to that described for the baffle device of FIG. 2. Sleeve 24 receives the venturi therein when the baffle device is in position.

Figure 5:
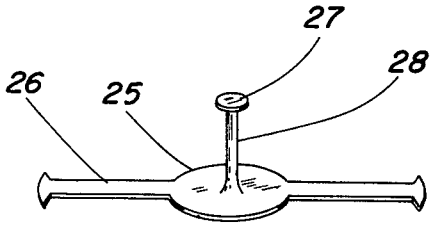
FIG. 5 is a perspective view of a fourth embodiment of a baffle utilized in the improvement of the present invention.

FIG. 5 shows another baffle device utilized by the present invention with the addition of small baffle 27 which is positioned in the bottom of the venturi on a small rod 28 attached to baffle 25. Baffle 27 can be used in a venturi with large inner diameters and should have a diameter not greater than about one-half the diameter of the passage through the venturi at the plane of baffle 27. Baffle 28 will assist in mixing the fuel and air properly. The device is attached to the carburetor wall by metal strips 26.

Figure 6:
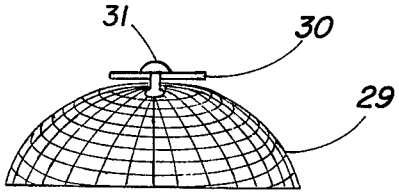
FIG. 6 is an elevational view of a screen attached to a baffle as utilized in the improvement of the present invention.

FIG. 6 shows a conical screen 29 which can be attached to baffle 30 by a rivet or bolt 31. Screen 29 assists the vaporization of fuel particles passing the throttle butterfly. Screen 29 can be attached to any of the baffles in the previous figures as long as it clears the throttle butterfly.

The previous devices can be baffle, conical or circular in design as long as they guide the fuel particles from the venturi equally into the airflow passing the throttle butterfly. They also assist in the vaporization and even distribution of the fuel-air mixture into the intake manifold.

The improvement of the present invention will distribute fuel evenly into the air flow passing the throttle butterfly, thereby resulting in the proper fuel-air mixture entering the intake manifold at all throttle settings.

It further will assist vaporization of the fuel within the carburetor, allowing an efficient intake manifold to heat and vaporize all of the fuel. An increase in economy and performance of approximately 20% may usually be obtained. Other advantages resulting from the improvement of the present invention are the ability to utilize regular gas in high compression engines without detonation occurring, and the ability to increase the ignition timing by six to eight degrees. The mixture of the carburetor may also be leaned out more for a particular power rating, and better combustion of the fuel-air mixture is obtained, thereby minimizing the pollutants expelled in the engine exhaust.

What is claimed is:

1. In a fuel distribution system having a carburetor for combining a fuel spray with air passing therethrough, the carburetor including a venturi for introducing the fuel spray into the air, the carburetor further including a cylindrical wall portion defining a passageway, the combined fuel and air passing from the venturi through the passageway, a butterfly valve being located within the passageway and operable to vary the sizes of the two openings between opposed ends of the butterfly valve and the wall portion of the carburetor on opposite sides of a diameter of the passageway in order to regulate the flow of the combined fuel and air through the passageway, the improvement comprising:

a baffle mounted to the venturi and positioned between the venturi and the butterfly valve to evenly distribute the combined fuel and air to the two openings defined by the opposed ends of the butterfly valve and the wall portion of the carburetor; and a mounting sleeve fitted and secured to the venturi, said baffle being connected to said mounting sleeve, said mounting sleeve being positioned between the venturi and the cylindrical wall portion and being spaced inwardly from the cylindrical wall portion.

2. The improvement of claim 1 in which said baffle is circular and is positioned concentrically within the passageway.

3. The improvement of claim 2 in which the venturi is generally cylindrical and has a diameter, the circular baffle having a diameter about equal to the diameter of the venturi.

* * * * *